US005418364A

United States Patent [19]

Hale et al.

[11] Patent Number: 5,418,364

[45] Date of Patent: May 23, 1995

[54] OPTICALLY MULTIPLEXED DUAL LINE OF SIGHT FLIR SYSTEM

[75] Inventors: Robert A. Hale; Fred S. Hurt, both of Ellicott City; William F. Clarke, Westminster; Victor J. Norris, Jr., Hunt Valley, both of Md.

[73] Assignee: Westinghouse Electric Corporation, Pittsburgh, Pa.

[21] Appl. No.: 54,109

[22] Filed: Apr. 28, 1993

Related U.S. Application Data

[63] Continuation of Ser. No. 754,777, Sep. 4, 1991, abandoned.

[51] Int. Cl.[6] ..... F41G 7/00

[52] U.S. Cl. ..... 250/344; 244/3.16

[58] Field of Search ..... 250/334, 348, 347; 244/3.16

[56] References Cited

U.S. PATENT DOCUMENTS

| | | | |
|---|---|---|---|
| 2,919,350 | 12/1959 | Taylor et al. | 250/348 |
| 3,076,961 | 2/1963 | Bibbero | 342/53 |
| 3,641,261 | 2/1972 | Chaplin et al. | 358/109 |
| 4,028,991 | 6/1977 | Kuby | 89/41.03 |
| 4,264,907 | 4/1981 | Durand, Jr. et al. | 342/53 |
| 4,319,242 | 3/1982 | Lewis | 342/67 |
| 4,527,055 | 7/1985 | Harkless et al. | 250/234 |
| 4,639,774 | 1/1987 | Fried | 358/105 |
| 4,780,719 | 10/1988 | Frei et al. | 342/53 |
| 4,868,652 | 9/1989 | Nutton | 358/113 |
| 4,905,292 | 2/1990 | Wentworth et al. | 382/1 |
| 4,963,963 | 10/1990 | Dorman | 358/113 |
| 5,049,740 | 9/1991 | Pines et al. | 250/235 |
| 5,072,890 | 12/1991 | Klaus, Jr. et al. | 244/3.16 |

FOREIGN PATENT DOCUMENTS

| | | | |
|---|---|---|---|
| 60-33069 | 2/1985 | Japan | 250/347 |

*Primary Examiner*—Mark Hellner

[57] ABSTRACT

A dual line of sight forward looking infrared (FLIR) navigation and targeting system including two separate infrared turrets housing respective optical gimbal assemblies which simultaneously provide two independently controlled lines of sight, one of which has wide field(s) of view for implementing a pilotage function and the other has narrow magnified field(s) of view for implementing a targeting function. Both lines of sight are merged following individual temperature compensating image gain and level adjusting operations in an optical multiplexer assembly, the output of which is coupled to a single IR detector in the form of a focal plane array having time delay integration. Two separate FLIR video image signals are generated in a single common processor, one for pilotage and one for targeting which can be viewed simultaneously and independently. The processor is also utilized and integrated with a radar system.

18 Claims, 7 Drawing Sheets

OPTICALLY MULTIPLEXED DUAL LINE OF SIGHT FLIR SYSTEM

This application is a continuation of application Ser. No. 07/754,777, filed Sep. 4, 1991, now abandoned.

CROSS REFERENCE TO RELATED APPLICATIONS

This application is related to the following applications which are assigned to the assignee of this invention:

"Stabilized Optical Gimbal Assembly", U.S. Ser. No. 07/754,771, filed on Sep. 4, 1991, still pending.

"Non-Integral Pixel Compression For Second Generation FLIR Sensors", U.S. Ser. No. 07/754,776, filed on Sep. 4, 1991, now U.S. Pat. No. 5,307,427.

BACKGROUND OF THE INVENTION

1. Field of the Invention

This invention relates generally to forward looking infrared (FLIR) systems and more particularly to a FLIR system utilized for both navigation and target acquisition/tracking.

2. Description of the Prior Art

Forward looking infrared (FLIR) systems are generally known, particularly as it relates to their use in connection with military aircraft which have the requirement of flying at low altitudes and acquiring targets at night for the purpose of delivering armorment or ordnance against them. Current state of the art systems generally require two separate and distinct infrared sensing systems which alternately operate in either/or operating modes, i.e. only one mode at a time. One system has a wide field of view that develops an IR picture looking ahead of the aircraft in order to present information to a pilot for the purposes of flying the aircraft in what is referred to as a pilotage mode. This system is known as the navigation FLIR. Additionally, a separate FLIR system is located on the aircraft for implementing what is referred to as the targeting function which comprises acquisition and tracking of a target and is known as the targeting FLIR. The second system has a narrow field of view that has magnification or telescopic properties such as a zoom capability so that targets can be located. The targeting FLIR system normally produces a high magnification visual image that enables the pilot to survey for the target and acquire the target in time to maneuver his aircraft for attack and weapon delivery.

The state of the art has, moreover, developed from locating the pilotage and targeting FLIR systems in pods mounted beneath the aircraft to an internally mounted system including a single small optical turret protruding from the aircraft. Such a system includes a single optical gimbal assembly providing a single line of sight which includes two aligned fields of view, a wide field of view used for pilotage purposes, and a narrow field of view utilized for limited targeting. With such a system coupled to a helmet mounted sight and display (HMS/D) unit, it provides a pilot with the ability to look in all forward directions for his navigation or pilotage purpose and it also provides him with an optical zoom to give a relatively smaller or narrower magnified field of view of a potential target so that the pilot can look down and observe the target by manually switching from the wide pilotage field of view to the narrower targeting field of view. However, there are inherent limitations in such an optical system where there is only one gimbal and one line of sight because it is impossible for such a system to simultaneously provide two separate images along separate lines of sight, such as where the pilot needs to control one line of sight which is slaved to his head in order to fly the aircraft, and the other line of sight needs to search for and acquire a target which is located at a bearing that is generally offset from the longitudinal axis of the aircraft and pilot's line of sight.

Accordingly, it can readily be seen that switching back and forth between pilotage and targeting modes in a single line of sight system can impair the pilot's situational awareness where, in addition to flying the aircraft under relatively difficult conditions, e.g. close to the ground, he must turn his head not only to find the target, but must also often update the tracking of the target once acquired. Therefore, it offers a low probability of his performing a successful mission, which, in addition to flying the aircraft, is to seek out and destroy a target in a first pass attack sequence.

SUMMARY OF THE INVENTION

It is a primary object of the present invention, therefore, to provide an improvement in forward looking infrared (FLIR) systems which provide both a navigation or pilotage function and a target acquisition and tracking or targeting function.

It is a further object of the invention to provide an improvement in a FLIR system by including dual lines of sight, one for the pilotage function, and one for the targeting function, wherein relatively wide field(s) of view are provided for the pilotage function and relatively narrow field(s) of view are provided for the targeting function.

It is yet another object of the invention to provide an improvement in FLIR systems utilized for navigation and targeting wherein the pilotage and targeting function operate simultaneously and independently along two separate and autonomously driven lines of sight in order to maximize pilot awareness of where he is at any given moment during a mission.

It is still yet a further object of the present invention to provide an improvement in FLIR systems used for navigation and targeting by combining them with a radar fire control system so as to share hardware and operational assets and features and hence improve overall capability and cost effectiveness.

It is still another object of the present invention to provide a FLIR system which is relatively smaller in size, volume and weight and results in reduction in overall cost to fabricate.

Briefly, the foregoing and other objects are achieved by a dual line of sight FLIR navigation and targeting system including two separate infrared turrets housing respective optical gimbal assemblies providing two independently controlled lines of sight, one of which has wide field of view(s) for implementing the pilotage function and which is primarily slaved to the operator's head via a helmet mounted sight and display system, and other being magnified field of view(s) independently controlled so as to point at a target irrespective of where the pilot is looking. Both lines of sight are brought together in an optical multiplexer assembly which is optically coupled to a single IR detector. Two separate FLIR video signals are generated in a single common processor, one for pilotage and one for targeting, which can be simultaneously and independently viewed by an operator which may be, for example, the pilot of an aircraft.

BRIEF DESCRIPTION OF THE DRAWINGS

The following detailed description of the invention will be more readily understood when considered together with the accompanying drawings in which.

DETAILED DESCRIPTION OF THE INVENTION

Figure 1:
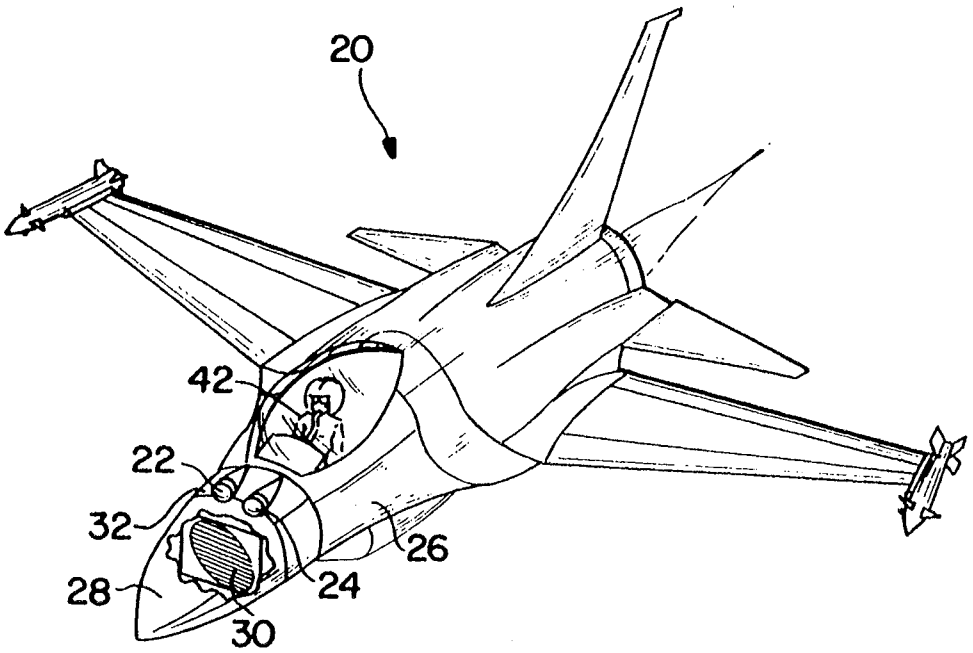
FIG. 1 is a perspective view of an aircraft which operates as an operational platform for the subject invention.

Referring now to the drawings wherein like reference numerals refer to like components throughout, reference is first made to FIG. 1 wherein there is shown a typical operating environment for the subject invention and which consists of an aircraft 20 including two forward looking infrared (FLIR) turrets 22 and 24 which are located side by side on the front portion of the fuselage 26 behind a radome 28 which covers a fire control radar system, the antenna of which is shown by reference numeral 30. The space aft of the antenna 30 includes a compartment 32 which is utilized not only for mounting the radar system, not shown, but also the FLIR apparatus in accordance with the subject invention, to be hereinafter explained. The two turrets 22 and 24 operate as housings for two optical gimbal assemblies, not shown, one of which 24 is used for target acquisition and tracking, hereinafter referred to as "targeting", while the other 22 is used for pilot navigation, herein referred to as "pilotage". The targeting and pilotage gimbal assemblies are interchangeable.

Figure 2:
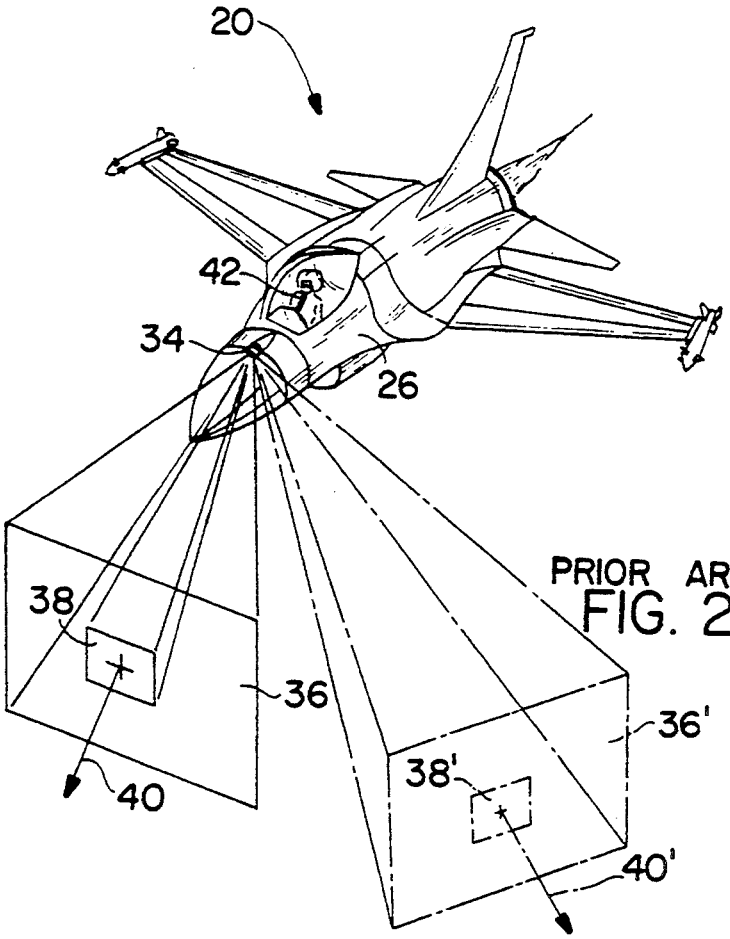
PRIOR ART FIG. 2
FIG. 2 is a perspective view of an aircraft which is equipped with a FLIR system in accordance with the known prior art.

The gimbals comprise stabilized receiving lens and mirror apparatus which fold the infrared (IR) energy in respective lines of sight to an optical multiplexer and IR detector to be described. The FLIR system, as illustrated in FIG. 2, discloses a prior art system including a single FLIR turret 34 which generates two fields of view 36 and 38 along a single line of sight 40. This means that a pilot 42 flying the aircraft 20 while having an enlarged field of view 36 which is slaved to a helmet mounted sight and display (HMS/D), not shown, and is used for pilotage, also includes a relatively smaller field of view 38 which is used for limited targeting. It can be seen then that pilot's line of sight 40 must normally change from a direction about the aircraft's velocity vector while he is flying the aircraft 20 and in the enlarged field of view 36 to the direction 40' of the target location while he is searching for and tracking the target while in the smaller field of view 38' as the pilot 42 maneuvers the aircraft for attack and weapon delivery.

Such a prior art system provides an inherent limitation which is built into the system. The pilot must alternate his head position between the navigation line of sight 40 and the targeting line of sight **40*a***, thereby interrupting his situational awareness which could affect his reaction time and accordingly his ability to fly the airplane along a predetermined flight path for executing a successful first pass attack.

Figure 3:
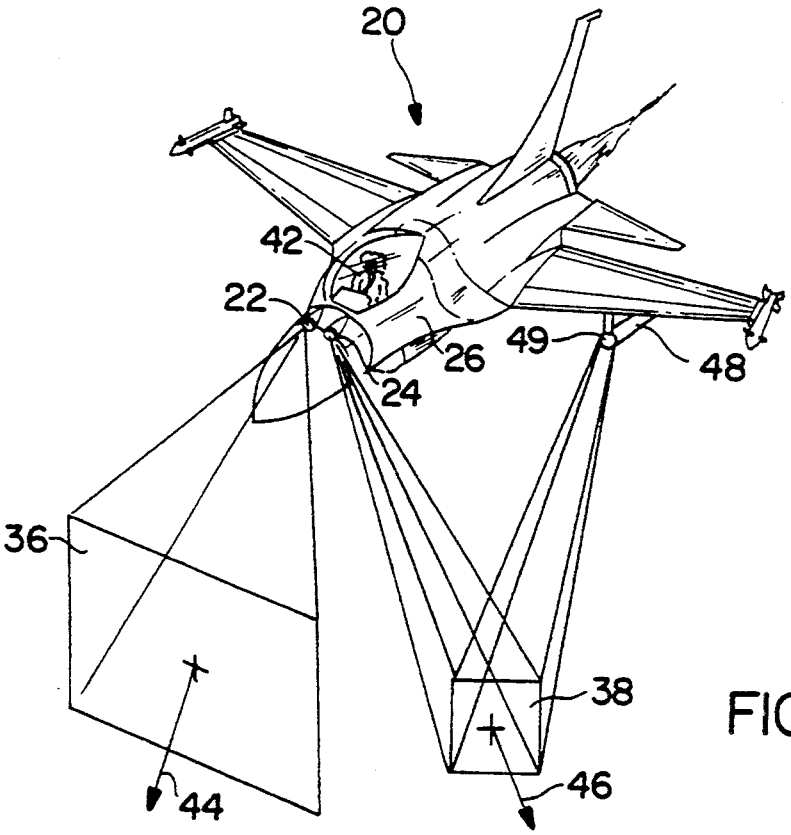
FIG. 3 is a perspective view of an aircraft which is equipped with a dual line of sight FLIR system in accordance with the subject invention and illustrating its interaction with a missile having an IR imaging seeker.

The present invention, on the other hand, as shown in FIG. 3, by virtue of having two FLIR turrets 22 and 24, which generate respective pilotage and targeting fields of view 36 and 38 along two separate and independently controlled lines of sight 44 and 46 overcomes this problem as will become apparent as this detailed description proceeds. Further as shown, a missile 48 with an IR imaging seeker 49 can be made to slave to the targeting field of view 38.

Figure 4:
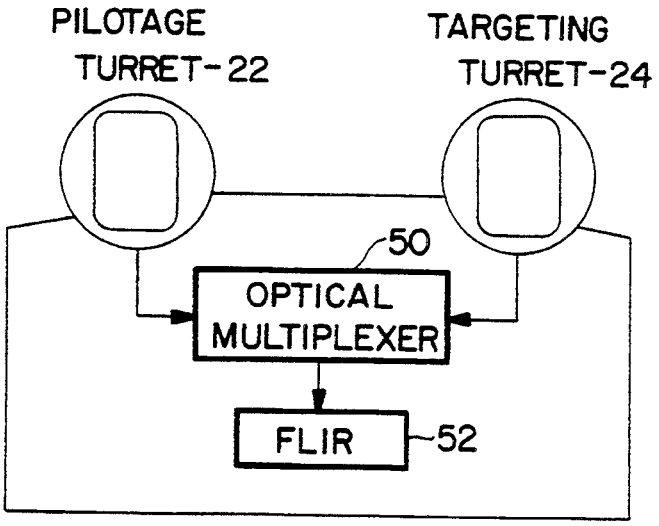
FIG. 4 is a block diagram broadly illustrative of the FLIR system of the subject invention.
Figure 5:
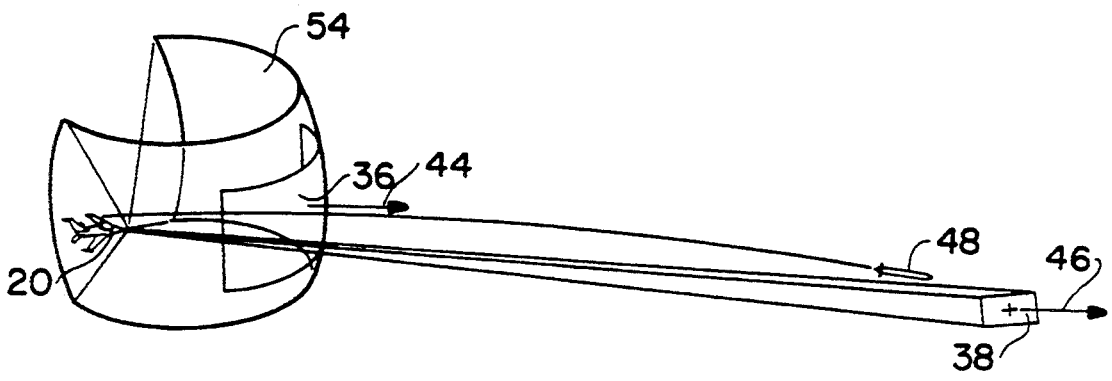
FIG. 5 is a diagram illustrative of the two fields of view obtained by the subject invention.
Figure 6:
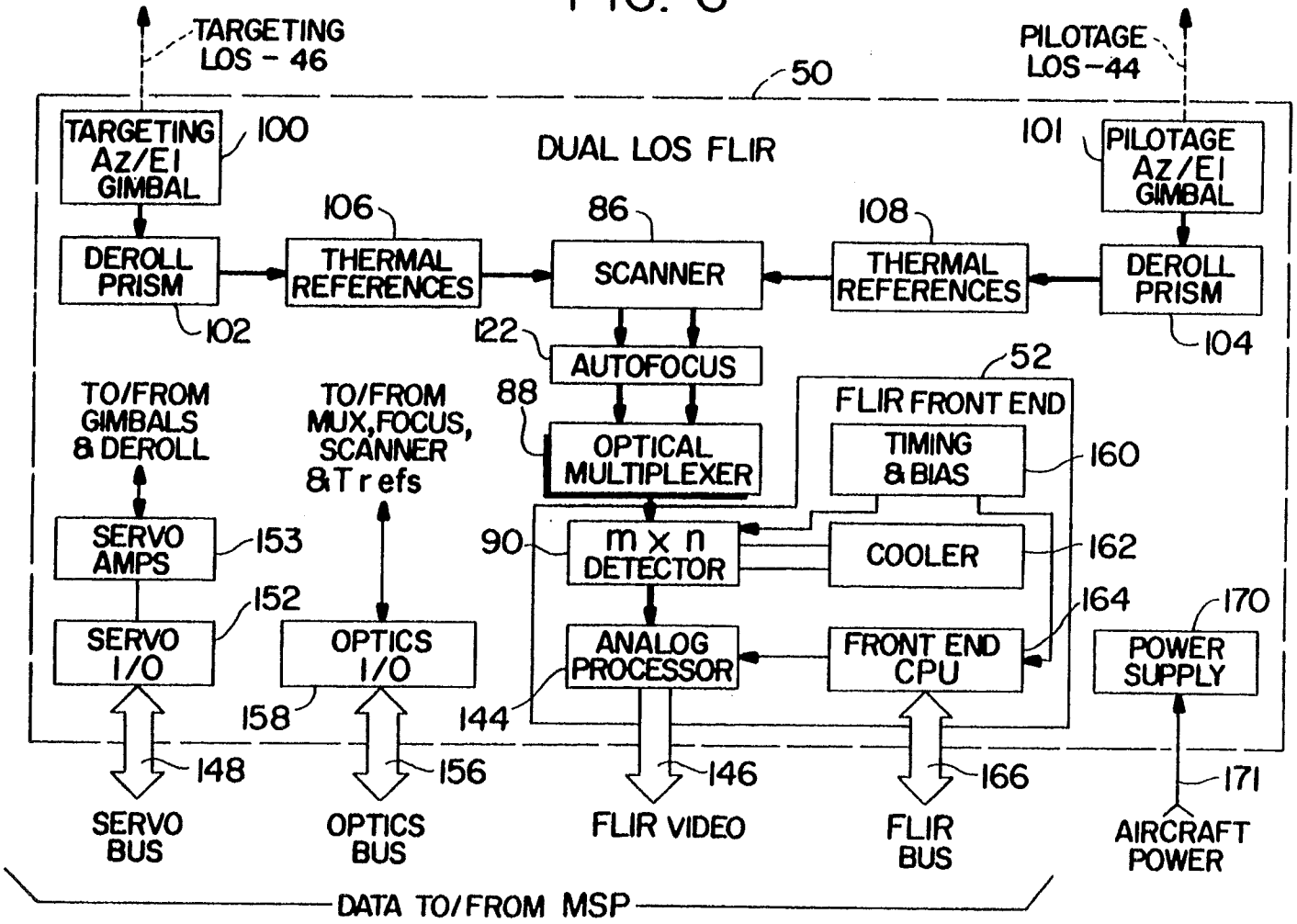
FIG. 6 is a block diagram illustrative of the preferred embodiment of the subject invention.
Figure 7:
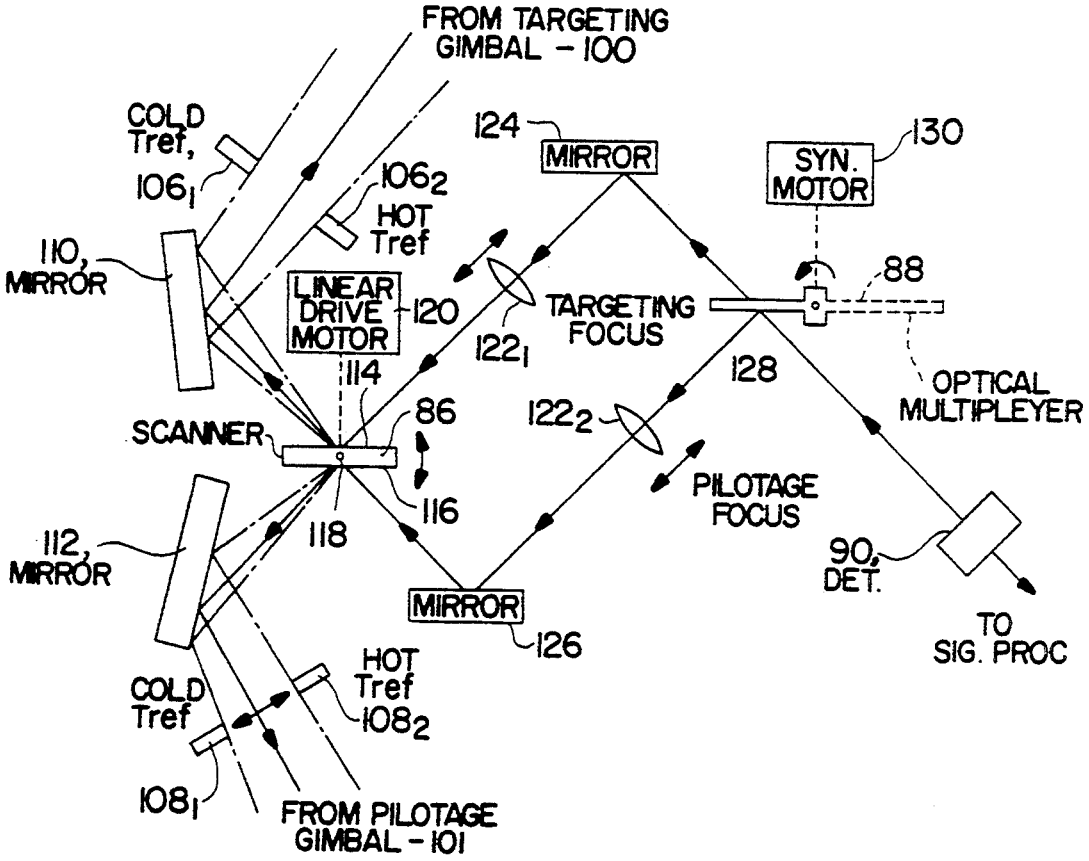
FIG. 7 is a mechanical schematic diagram illustrative of the apparatus utilized for optically multiplexing dual lines of sight implemented in the configuration shown in FIG. 6.
Figure 8:
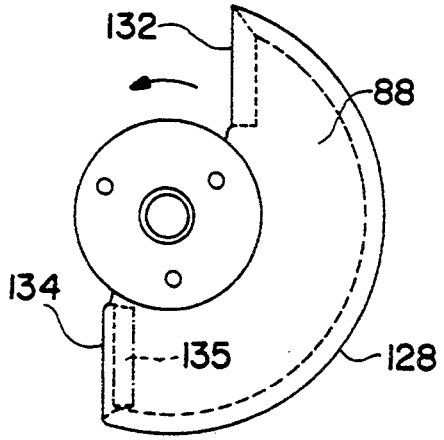
FIG. 8 is a front planar view of the optical multiplexer illustrated in FIGS. 6 and 7.
Figure 10:
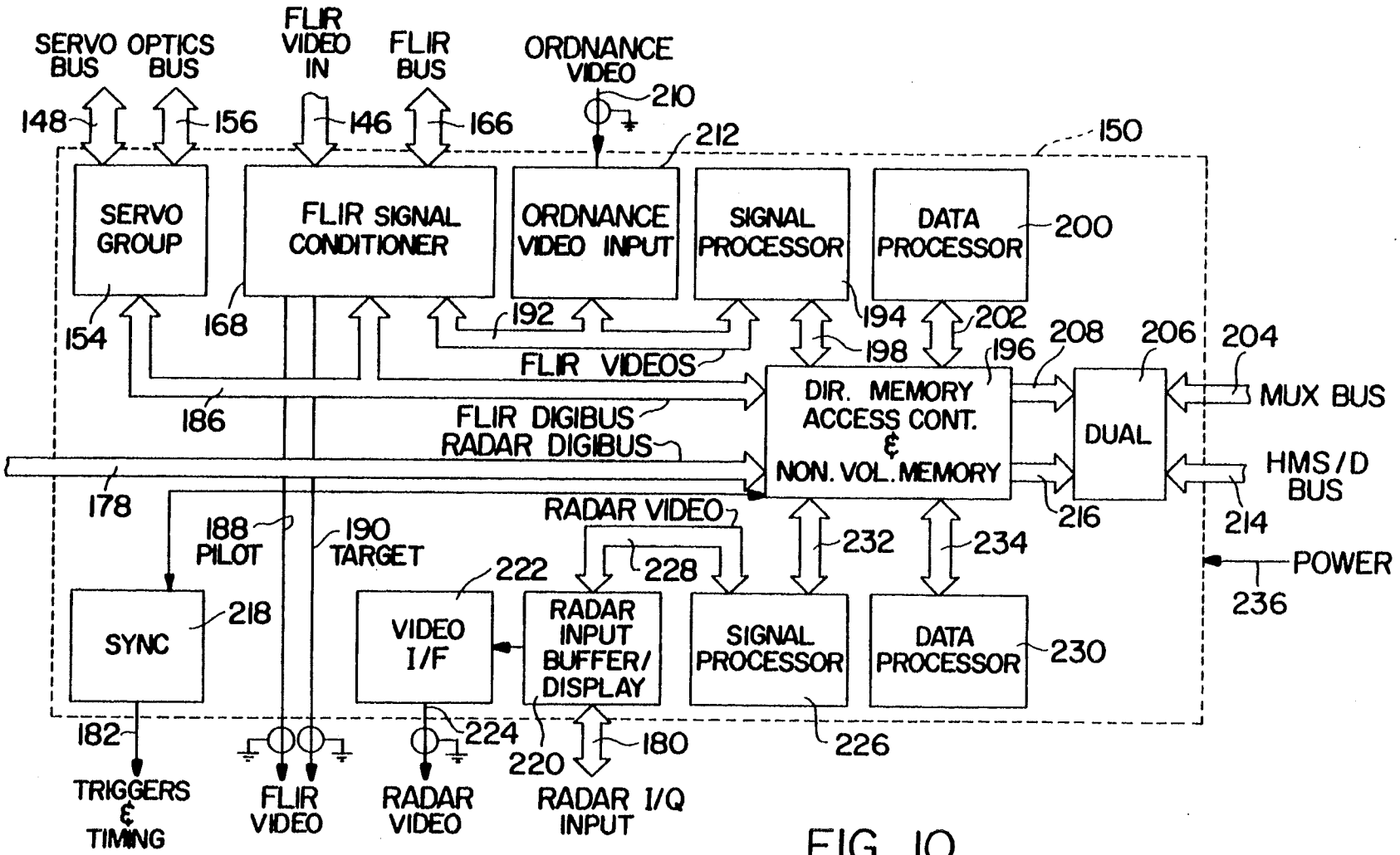
FIG. 10 is an electrical block diagram illustrative of the multi-sensor processor shown in FIG. 9.

Referring now to FIG. 4, the subject invention, as broadly shown, is implemented at a reduced cost and in a relatively small package by coupling the respective IR image energy from the turrets 22 and 24 to an optical multiplexer assembly 50, the details of which are shown in FIGS. 7 and 8, which in turn is coupled to common FLIR circuitry 52, the details of which are shown in FIGS. 6 and 10. The lines of sight 44 and 46 can be slewed over an area 54 as shown in FIG. 5 where it is possible to have up to $\pm 60°$ in azimuthal coverage and typically up to $+60°$ and down to typically $-20°$ in elevation coverage. This coverage is predominantly limited by aircraft installation location and by the aerodynamic fairings, not shown, which may be located behind the turrets 22 and 24 to smooth the air flow around them. Without such fairings, the coverage could be almost continuous in azimuth.

Referring now to FIG. 6, the lines of sight 44 and 46 are implemented by a pair of independent targeting and pilotage gimbals 100 and 101 which are controlled for movement in both azimuth and elevation. The targeting gimbal 100 is of a unique design and provides a typical magnification on the order of $\times 11$. This gimbal 100 is disclosed in detail in the above referenced related application entitled "Stabilized Electro-Optical Imaging Gimbal Assembly", U.S. Ser. No. 07/754,771, and which is incorporated herein by reference. The pilotage gimbal 101 is of a conventional design well known to those skilled in the art.

The targeting and pilotage gimbals 100 and 101 feed into a pair of deroll prisms 102 and 104 which operate to keep respective images oriented with the pilot's line of vision. The IR images pass through two sets of thermal references 106 and 108 which are further shown in FIG. 7 comprising a cold and hot temperature reference $\mathbf{106}_1$ and $\mathbf{106}_2$ in the targeting path and a second cold and hot thermal reference $\mathbf{108}_1$ and $\mathbf{108}_2$ in the pilotage path. These temperature references operate to continually insert appropriate reference video levels for calibration purposes into the video stream of both the pilotage and the targeting imagery outputted from the detector 90 when the pilotage line of sight 44 is permitted to look, for example, up in the sky while the targeting line of sight 46 is pointed down at the terrain where a target is located. The dynamic response of both images is thus adjusted and maintained in accordance with the level of respective scene information observed by the gimbals 100 and 101.

Further as shown in FIG. 7, the targeting field of view from the gimbal 100 is constrained by the cold and hot thermal references 1061 and 1062, while the pilotage field of view from the gimbal 101 is constrained by the cold and hot thermal references $108_1$ and $108_2$. The infrared energy passing between the two sets of thermal references are reflected from a pair of stationary mirrors 110 and 112 onto opposite flat reflecting faces 114 and 116 of a planar scanner member 86 which oscillates back and forth about a pivot 118. The scanner 86 is driven by a linear drive motor 120 at a 30 Hz rate typically to produce respective scan patterns from the faces 114 and 116, while having no retrace interval.

The detector 90 in effect looks at the images coming from the targeting and pilotage gimbals 100 and 101 on the scanner faces 114 and 116 via an optical multiplexer 88, an auto-focus mechanism consisting of lens groups $122_1$ and $122_2$ and a second pair of stationary mirrors 124 and 126 located between the scanner 86 and multiplexer 88.

The optical multiplexer 88, the details of which are shown in FIG. 8, comprises a rotating segment of a disk type member or wheel 128 which is rotated at a 60 Hz rate by a synchronous motor 130. The multiplexer disk 128 operates to alternately block and pass infrared images reflected from the scanner faces 114 and 116 which simultaneously scans both fields of view from the pilotage and targeting gimbals 98 and 100. In FIG. 8, the multiplexer disk 128 includes mutually offset leading and trailing edges 132 and 134. A relatively small line type footprint 135 is produced along the edge 134.

Directing attention now to the infrared detector 90, it can be comprised of a single line array or a second generation focal plane array including time delay integration (TDI). Preferably, it is comprised of a second generation infrared focal plane array (IRFPA) of the type manufactured and sold by the Santa Barbara Research Center, Amber Engineering, Loral Infrared Imaging Systems and others.

The detector 90 implements 480 channels of pixel information which is coupled to an analog processor 144 shown in FIG. 6, and which in fact comprises an analog to digital converter which operates to generate a FLIR video digital data stream. This data stream is fed to a FLIR video bus 146. FIG. 6 thus discloses the salient features of the invention, that is, dual lines of sight passing through dual independent thermal references into a common scanner followed by dual independent focus mechanisms and from there into an optical multiplexer and onto a focal plane array detector. This results in a relatively compact, low cost, multifunction infrared package.

Figure 9:
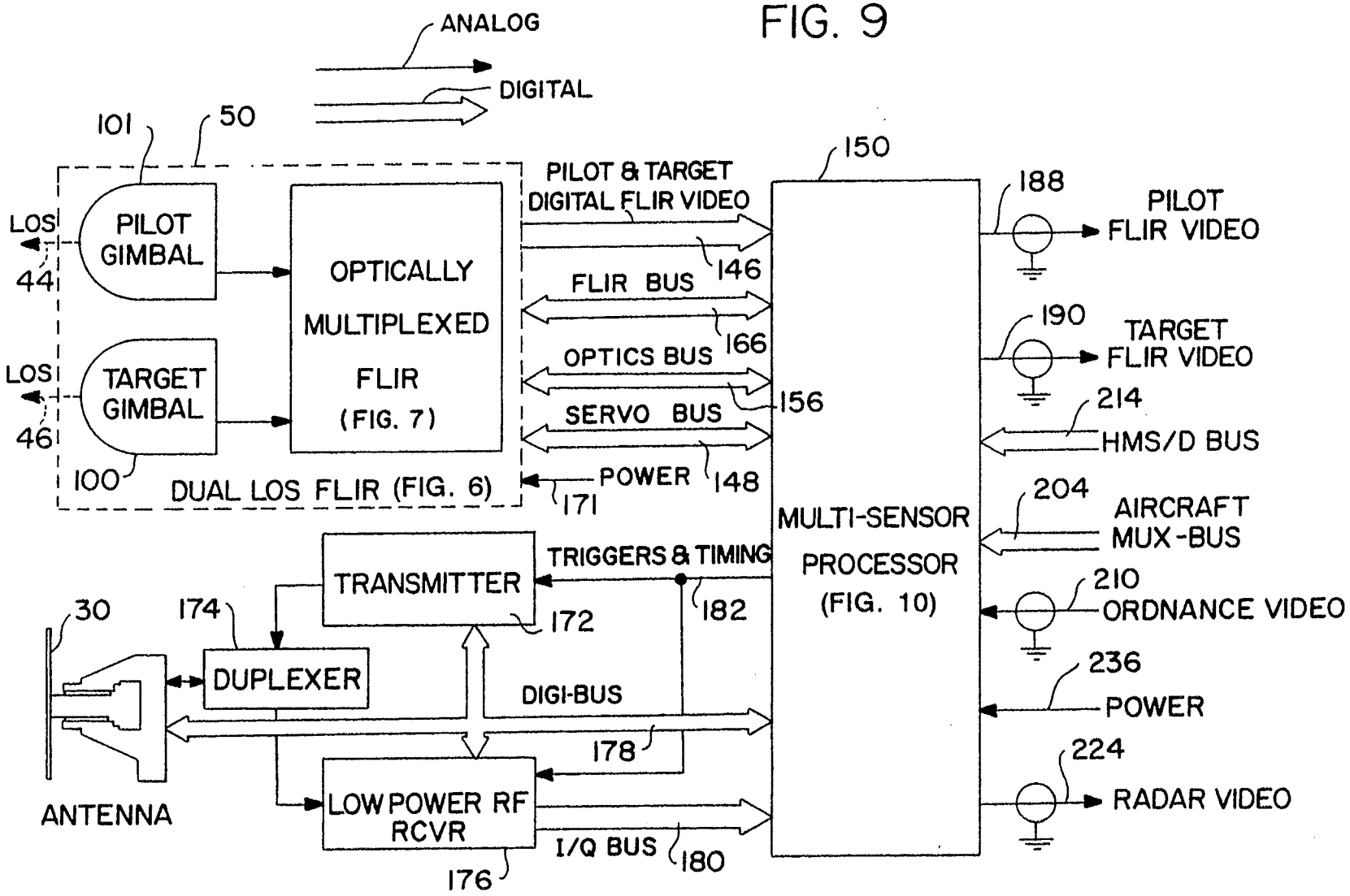
FIG. 9 is a block diagram illustrative of an integrated system including the dual line of sight FLIR system shown in FIG. 6 together with a fire control radar system.

Along with the basic IR sensor or detector 90, FIG. 6 additionally discloses means for implementing a variety of support functions that are also required. One of these is a digital servo bus 148 that couples to a multisensor 150 processor which is shown in FIGS. 9 and 10, and will be referred to subsequently. The servo bus 148 couples to a servo input/output block 152 which includes, a digital to analog converter which produces the necessary analog signals required to, for example, drive the gimbals 100 and 101 and the deroll prism mechanisms 102 and 104 via a servo amplifier block 153. Conversely, analog information such as gimbal rate information, and gimbal position information is brought down from the gimbals 100 and 101 through the servo block 153 to the input/output block 152 which also includes an analog to digital converter. Digitized feedback signals are coupled back to the servo bus 148 where they are fed to a servo group signal processor 154 (FIG. 10).

Also shown in FIG. 6 is an optics digital bus 156 which is coupled to an optics input/output block 158 which includes analog to digital and digital to analog converters providing command signals required to: operate the multiplexer drive motor 130 in synchronism with the scanner motor 120; drive the autofocus mechanisms $122_1$ and $122_2$ to the sharpest focus possible; and, provide control voltages which cause the thermal references $106_1$ and $106_2$ and $108_1$ and $108_2$ to change their respective reference levels to correspond with the specific scene temperatures being viewed by the gimbals 100 and 101. Again, feedback signals from these devices are brought back through the optics input/output block 158 where they are changed from analog to digital signals and fed to the servo group 154.

A timing and bias circuit 160 is used to control the clocking of the detector 90 in FIG. 6. Cooler apparatus 162 required for the operation of the detector 90 is also depicted. A digital processing unit 164 and a FLIR bus 166 couples back to a FLIR signal conditioner 168 in the multi-sensor processor 150 and will be discussed when FIGS. 9 and 10 are considered. Finally, a basic power supply 170 is shown in FIG. 6 which takes power from the aircraft 20 over a power line 171 and provides the voltages necessary to operate the dual line of sight FLIR apparatus depicted in FIGS. 6 and 7.

Referring now to FIG. 9, the multi-sensor processor 150, in addition to being coupled to the FLIR apparatus 50, is also interfaced with radar apparatus comprised of a transmitter 172 which is coupled to a radar antenna 30 (FIG. 1) via a duplexer 174, a low power RF receiver 176, a digital control bus 178, a radar output signal I/Q bus 180 and a trigger and timing circuit line 182. These elements are well known to those skilled in the art and thus do not need to be discussed in any detail.

The multi-sensor processor 150 as further illustrated in FIG. 10 includes the FLIR signal conditioner 168. This circuit element receives the digital FLIR video digital data stream 146 that was generated by the IR detector array 90 and converted to digital form in the processor 144 shown in FIG. 6. The FLIR signal conditioner 168 operates on the information that was also inserted in the video data stream by the thermal references $106_1$, $106_2$ and $108_1$ and $108_2$ and is analyzed therein. The FLIR signal conditioner includes computer apparatus, not shown, which observes any level differences in the 480×4 detector 90. If the respective IR detectors are producing different levels, correction factors are applied to the digital video inputted on the bus 146 to cause all 480 detectors to be operating at the same level. Such commands are fed back to the front end CPU 164 of FIG. 6 by means of the FLIR digital bus 166. The FLIR signal conditioner 168 analyzes information from the four thermal references $106_1$, $106_2$, $108_1$ and $108_2$ so that in the event temperature differentials occur, the gain of all 480 detector channels are compared and corrected until all of the gains are the same.

Separate correction factors are computed for the pilotage video based on the information provided by the pilotage thermal references 108$_1$ and 1082 and on the targeting video data stream by the information provided by the thermal references 106$_1$ and 106$_2$. These correction values differ due to the different scene levels seen by the pilotage and targeting lines of sights. These correction values are coupled to the thermal references 106$_1$ . . . 108$_2$ through a digital bus 186, called the FLIR digibus, the servo group 154 and the optics bus 156. The corrected video signals, be they pilotage or targeting video, are then converted to analog signals which are coupled to a pair of coaxial cable signal lines 188 and 190 which respectively couple to HMS/D unit, HUD unit and/or panel mounted displays, not shown, located for pilot use in the cockpit of the aircraft 20 (FIG. 3).

At the same time that the FLIR signal conditioner block 168 produces pilotage and targeting analog video signals, corresponding digital video outputs are generated thereby which are outputted on an external FLIR video digital bus 192 to a reprogrammable digital signal processor shown by reference numeral 194. The reprogrammable digital signal processor 194 is capable of implementing a number of operations on the digital video data stream such as video autotracking and IRST processing. A direct memory access control and non-volatile memory unit 196 is included in the multi-sensor processor 150 which acts as a common memory for all of the processors included therein. For example, it is coupled to the FLIR signal processor 194 via a digital bus 198. Also, it is coupled to FLIR data processor 200 via a digital data bus 202.

Thus it is now possible for the FLIR system according to the subject invention to produce analog pilotage video signals for observation by the pilot as well as digital video signals that are transported by the FLIR video bus 192 to the signal processor 194 so that certain aircraft automation features can be introduced. For example, in FIG. 3 the targeting line of sight 46 included a narrow field of view 38. It also shows a missile 48. Since it is feasible for the aircraft 20 to carry missiles having IR imaging seekers 49, the FLIR video signals which are processed by the signal processor 194 can introduce several other capabilities. For example, the pointing angles of the targeting FLIR line of sight 46 can be passed from the servo group 154 through the FLIR digibus 186 to the aircraft's multiplex bus 204 via the memory unit 196, a dual multiplex bus 206 and an intermediate digital bus 208. The angles are then coupled from the aircraft to the missile 48, for example, (FIG. 3) causing the missile seeker 49 to point in the general direction of the targeting line of sight 46. Because of multiple misalignments or boresight errors between the lines of sight of the targeting FLIR and the missile seeker, including bending or flexing between the airplane 20 and the mounting structure of the missile 48, these lines of sight frequently are not coincident.

To achieve a final registration, the IR image being processed by the missile 48 can be brought into the multi-sensor processor 150 through an ordnance video link comprising a coaxial cable 210 coupled into block 212 shown as the ordnance video input. The signal processor 94 has the capability of comparing the two images, the one produced by the targeting FLIR, and the other produced by the ordnance and performing a video registration function by correlating the respective images. Correlation errors are then sent back as pointing correction signals fed out through the internal dual MUX bus 206 and the aircraft MUX bus 204 until the missile seeker 49 line of sight is brought into exact registration with the targeting line of sight. Also the dual MUX bus 206 and memory unit 196 via bus 216 are coupled to the helmet mounted steering and display (HMS/D) bus 214 which is adapted to return receive digital signals indicative of the pilot's head movement and which are used in the pointing of the dual lines of sight.

Since there exists a need to achieve smaller volumes, sizes, weights, power as well as cost reduction for generating the pilotage and targeting functions, the multi-sensor processor 150, as shown in FIG. 10, also implements the radar signal processing functions and includes, among other things, a synchronizer 218 which generates all the triggers and timing signals required for the operation of the radar apparatus shown in FIG. 12. Additionally, the radar I/Q digital inputs from the receiver 176 of FIG. 9 are fed into a digital input buffer 220 via the digital I/Q input bus 180 where it is then converted into an analog IF signal in a video I/F unit 222 where it is returned to the cockpit for display in the aircraft 20 via the coaxial cable lead 224. The digital radar input coupled to the buffer 220, moreover, is fed to a signal processor 226 by means of a radar digital video bus 228. The radar signal processor, moreover, interacts with a data processor 230 via the direct memory access control and non-volatile memory unit 196 via data buses 232 and 234 to generate radar video signals for the video I/F unit 222. Finally, reference numeral 236 indicates a power input lead from the aircraft to the multi-sensor processor 170 for supplying power thereto.

Thus what has been shown and described is a forward looking infrared FLIR system integrated with a radar fire control system and having both a pilotage and targeting function and including two FLIR turrets which are driven independently so that a pilot can by optical multiplexing view a pair of images which are generated simultaneously along separate lines of sight by a focal plane detector array having time delay integration.

Having thus shown and described what is at present considered to be the preferred embodiment of the invention, it should be noted that the same has been made by way of illustration and not limitation. Accordingly, all modifications, alterations and changes coming within the spirit and scope of the invention as set forth in the appended claims are herein meant to be included.

We claim:

1. An independent dual line of sight forward looking infrared navigation and target acquisition and tracking system mounted on an aircraft for providing separate pilotage and targeting functions, comprising:

a first and a second line of sight optical gimbal assembly, independently controllable by an operator located in said aircraft, for receiving respective infrared images in first and second fields of view directed along separate first and second lines of sight, said first field of view comprising a relatively wide pilotage field of view and said second field of view comprising a relatively narrow targeting field of view;

first and second turret means located on a fuselage portion of said aircraft for respectively housing said first and second gimbal assembly;

first and second image deroll means located in respective optical paths of said first and second lines of sight for correcting any roll disorientation of the respective images introduced by said gimbal assemblies so that said images remain oriented with the line of vision of said operator;

first and second thermal reference means respectively located in said optical paths for continually inserting separate reference temperatures into a video data stream outputted from infrared detector means responsive to the respective images in said first and second field of view so that the dynamic response of both said images is independently adjusted and maintained in accordance with the level of respective scene information observed by said gimbal assemblies;

an optical multiplexer assembly including image scanner means located adjacent said first and second thermal reference means for receiving roll corrected infrared images from said gimbal assemblies and generating a single multiplexed output of two consecutive infrared images, one of said first field of view and one of said second field of view, said optical multiplexer assembly additionally including autofocus means in each of said optical paths for maintaining focus of said images for temperature changes encountered by said aircraft during aircraft operations;

infrared detector means responsive to said single multiplexed output of two consecutive infrared images and generating said video data stream; and signal processor means coupled to said infrared detector means and being responsive to said video data stream outputted from said infrared detector means for generating first and second video image signals, respectively, of said pilotage field of view and said targeting field of view for selective viewing by said operator.

2. The system as defined by claim 1 wherein said relatively narrow targeting field of view comprises a magnified field of view.

3. The system as defined by claim 1 wherein said first and second image deroll means each includes a deroll prism.

4. The system as defined by claim 3 wherein said first and second thermal reference means are located between the respective deroll prisms of said first and second image deroll means and said image scanner means.

5. The system as defined by claim 1 wherein said signal processor means includes signal conditioner means responsive to said first and second thermal reference means for generating control signals coupled to said infrared detector means for controlling the signal gain of said video data stream.

6. The system as defined by claim 5 wherein said infrared detector means includes a plurality of detector channels and wherein said control signals from said signal conditioner means equalizes the respective gains of said plurality of detector channels.

7. The system as defined by claim 1 wherein said signal processor means is also responsive to radar signals for generating radar video signals for viewing by said operator.

8. The system as defined by claim 6 wherein said signal processor means comprises a multi-sensor processor having respective digital signal and data processors for both infrared signals and radar signals and including a common memory coupled to all said processors.

9. The system as defined by claim 1 wherein said first and second turret means are located on a front fuselage portion of said aircraft.

10. The system as defined by claim 9 wherein said operator comprises a pilot of said aircraft.

11. The system as defined by claim 10 wherein signal processor means comprises a multisensor signal processor for controlling said gimbal assemblies and generating pilotage and targeting video signals for selective viewing by a pilot of said aircraft.

12. The system as defined by claim 1 wherein said optical multiplexer assembly includes input means directed toward said infrared energy in said first and second fields of view, mechanical scanner means located adjacent said input means and having first and second reflective image surfaces of the respective infrared energy in said first and second fields of view, an optical multiplexer located between said scanner means and said detector means, and being operable to alternate the blocking and passing of infrared energy directed thereto from said first and second reflective image surfaces of said scanner means.

13. The system as defined by claim 1 wherein said first and second thermal reference means each comprise hot and cold thermal reference means respectively located in said first and second fields of view and defining the outer edges of the energy applied to said first and second reflective image surfaces.

14. The system as defined by claim 13 wherein said scanner means comprises a pivotally oscillated scanner member including opposite flat first and second reflective image surfaces.

15. The system as defined by claim 14 wherein said thermal reference means and said reflective image surfaces are mutually offset with respect to one another and additionally including first and second stationary mirror means respectively located therebetween.

16. The system as defined by claim 14 wherein said optical multiplexer assembly further includes a rotating disk having an open portion for passing infrared image signals and a blocking portion for interrupting infrared image signals.

17. The system as defined by claim 16 wherein the pivotally oscillated scanner member and the rotating multiplexer disk are operated in synchronism.

18. The system as defined by claim 16 and additionally including first and second stationary mirror means respectively located between said first and second reflective image surface of said planar scanner member and said open and blocking portions of said rotating multiplexer disk.

* * * * *